United States Patent [19]

Elhaus et al.

[11] 4,373,706

[45] * Feb. 15, 1983

[54] APPARATUS FOR HEAT TREATMENT OF MATERIAL TO BE WORKED ON, ESPECIALLY OF ALUMINUM OR MAGNESIUM ALLOYS

[75] Inventors: Friedrich W. Elhaus, Jägerstrasse 117a, D-56 Wuppertal 1, Fed. Rep. of Germany; Bernhard Hilge, Adliswil, Switzerland

[73] Assignees: Friedrich Wilhelm Elhaus, Wuppertal, Fed. Rep. of Germany; Prolizenz A.G., Chur, Switzerland

[ * ] Notice: The portion of the term of this patent subsequent to Jan. 20, 1998, has been disclaimed.

[21] Appl. No.: 187,805

[22] Filed: Sep. 16, 1980

Related U.S. Application Data

[60] Division of Ser. No. 887,316, Mar. 16, 1978, Pat. No. 4,245,818, which is a continuation-in-part of Ser. No. 669,347, Mar. 22, 1976, Pat. No. 4,135,704, which is a continuation-in-part of Ser. No. 417,509, Nov. 20, 1973, Pat. No. 3,953,247.

[30] Foreign Application Priority Data

Nov. 21, 1972 [DE] Fed. Rep. of Germany ..... 2256978
Oct. 3, 1973 [DE] Fed. Rep. of Germany ..... 2349765

[51] Int. Cl.[3] ..... C21D 9/08; C21D 1/08; C21D 1/767

[52] U.S. Cl. ..... 266/252; 266/259

[58] Field of Search ..... 266/251, 252, 255, 256, 266/257, 259, 261; 198/774

[56] References Cited

U.S. PATENT DOCUMENTS 4,135,704 1/1979 Elhaus et al. ..... 266/261
4,245,818 1/1981 Elhaus et al. ..... 266/87

*Primary Examiner*—L. Dewayne Rutledge
*Assistant Examiner*—Alan E. Schiavelli
*Attorney, Agent, or Firm*—Ernest F. Marmorek

[57] ABSTRACT

Apparatus for heat treatment of metal pieces such as billets, ingots, bars and the like, by pre-heating using hot gas impingement in a pre-heating furnace, and then transference into a holding furnace using forced hot air circulation where the metal pieces are held for the time required at the desired heat treatment temperature.

9 Claims, 8 Drawing Figures

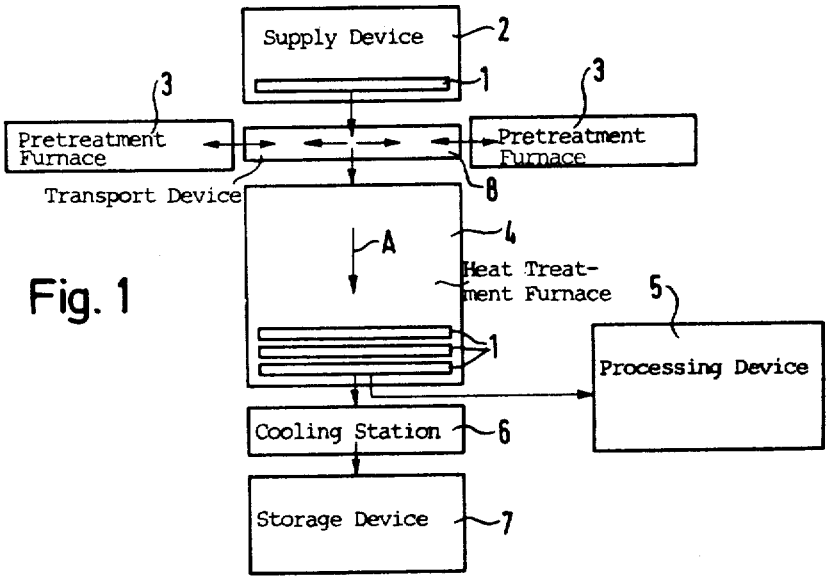
Fig. 1
Fig. 3
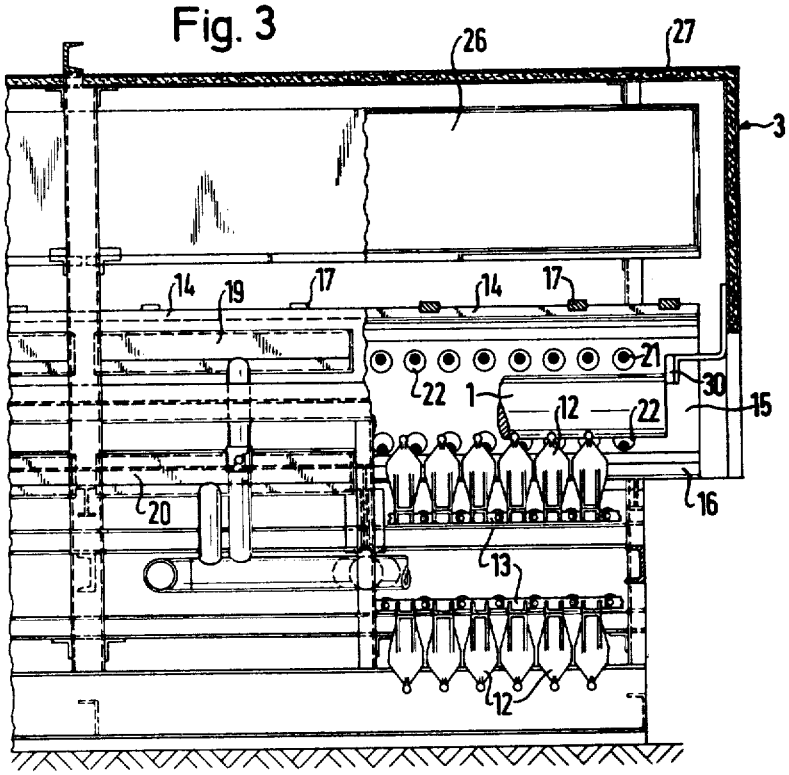

25
III
3
26
27
14
17
14
15
19
22
22
21
19
1
1'
18
12
29
24
21
20
20
16
16
28
13
12
III

A
B
B'
z
y
l
k
1
1'
42
42a
44
45
45'
46
α

APPARATUS FOR HEAT TREATMENT OF MATERIAL TO BE WORKED ON, ESPECIALLY OF ALUMINUM OR MAGNESIUM ALLOYS

CROSS-REFERENCE TO RELATED APPLICATIONS

This is a division of application Ser. No. 887,316, filed on Mar. 16, 1978, now U.S. Pat. No. 4,245,818, which is a Continuation-in-Part of application Ser. No. 669,347, filed on Mar. 22, 1976 now U.S. Pat. No. 4,135,704, which is a Continuation-in-Part of application Ser. No. 417,509, filed on Nov. 20, 1973 now U.S. Pat. No. 3,953,247.

BACKGROUND OF THE INVENTION

The invention relates to an apparatus for heat treatment of material to be worked on, such as cast strips and billets, as well as ingots, rods, tubes and the like, especially of aluminum or magnesium alloys. The heat treatment is of the general type in which the material is first pre-heated, and thereafter is held at a desired heat treatment temperature.

Cast strips, billets and extrusion and rolling products, are customarily subjected to a heat treatment in order to homogenize, heterogenize, or otherwise heat treat the material. For example, continuously cast billets of aluminum alloys are first pre-heated after the casting, then finally annealed at temperatures between 500° and 620° C., and thereafter cooled. During this treatment, the billets receive the structure desired for further working, such as for example extrusion or rolling. An example of such methods is found in U.S. Pat. No. 2,802,657 (Nesbitt).

The material is customarily pre-heated with circulated hot gas, flue gas or with circulated hot air. As a result of the comparatively low temperature of such a source of heat or "heater", the pre-heating step takes a very long time.

If the material is to be passed through the apparatus in a continuous manner or in a flow operation, one normally tries to transport the material at an equal and constant speed through the pre-heating zone and subsequently through the holding heat treatment zone in the furnace. If the pre-heating is of long duration, then the pre-heating zone must be disproportionately long with respect to the holding zone or the material, and upon entry into the holding zone, will not attain the proper annealing temperature.

In using prior art apparatus, in order to achieve different annealing temperatures, the temperature of the hot gas in the pre-heating area or zone, and in the holding phase area or zone must be finely controllable. This is normally very difficult and a change in the temperature of the hot gas is usually only possible within narrow limits. Additionally, as was noted above, in a flow-through operation, the material must normally be transported with equal speed through the pre-heating zone and the holding zone.

As a result of the above, there is imposed upon normal operations a restricted flexibility in treatment of materials, especially a restricted adaptability to the changing of conditions under which the material is treated.

An additional serious drawback in known devices is that during heat treatment, which eventually also comprises subsequent cooling, the material suffers uneven deformations which may result in distortion or bending of the material.

SUMMARY OF THE INVENTION

One of the principal objects of the invention is to provide an apparatus of the kind referred to above, but in which the noted drawbacks are avoided, and with which apparatus a material of consistent quality can be produced.

Another object of the invention is to permit improved adaptability to a variable cycle sequence sometimes required by different desired structures, different previous and subsequent auxiliary apparatus in the case of further treatment, interrupted operation, or operation under part load, and the like.

Further objects and advantages of the invention will be set forth in part in the following specification and in part will be obvious therefrom without being specifically referred to, the same being realized and attained as pointed out in the claims hereof.

Other objects of the invention will in part be obvious and will in part appear hereinafter.

With the above and other objects of the invention in view, the invention consists in the novel construction, arrangement and combination of the various devices, elements and parts, as set forth in the claims hereof, certain embodiments of the same being illustrated in the accompanying drawings and described in the specification.

In general, the objects of the instant invention are attained by providing at least one pre-heating furnace which utilizes hot gas impingement to rapidly heat the material, the hot gas having a temperature essentially higher than the treatment temperature. There is also provided a holding furnace or zone, maintained at the treatment temperature, wherein the material is transported from the pre-heating furnace by means of a transport device associated with the pre-heating furnace and the holding furnace, but drivable independently of the transport devices which may be provided in either furnace. This permits the material to be moved through each furnace and between the furnaces at rates that are independent of each other.

With the apparatus according to the instant invention, a number of advantages can be achieved during the heat treatment.

As a result of the passage of material through each furnace in a continuous manner, rather than in a batch-like manner, each piece or all parts of a long piece of material being treated, is treated under essentially the same condition. Each piece is pre-heated under essentially the same conditions, without regard to variations within the furnace, both during the pre-heating and the heat treatment stages. When the material is pre-heated by means of hot gas impingement, the pre-heating time is generally shorter than the heat retaining or heat treatment time. The pre-heating furnace may be heated either electrically or by means of a fuel or both types of heating may be provided. This offers the advantage to use that type of energy, namely, electrical energy or fuel combustion energy, which is available at minimum cost.

When using fuel, the material may be pre-heated by means of direct flame impingement (as is disclosed in U.S. Pat. No. 3,623,093 (Elhaus)).

The hot gas should in any case have a temperature higher than the heat treatment temperature of the material in the heat treatment furnace. This shortens the pre-heating time of pretreatment, and it is possible to better match the time for movement through the pre-treatment furnace and the heat treatment furnace. For example, the time for pre-heating a billet of aluminum alloy to a peak temperature of 500° to 570° C. is, depending on the billet diameter, between approximately 10 to 30 minutes. By pre-heating the billets in a separate device, an exact temperature check as well as the individual adjustability of the cycle sequence or speed of the material in the pre-heating furnace and of the travel speed through the holding furnace, make possible adaptability to change the cycle sequence, with great flexibility, as may be desirable in view of subsequent apparatus, different alloys to be treated, interrupted operation, and operation under part load.

Although the rapid pre-heating step would appear to be disadvantageous because of the large power requirement, it has, surprisingly, in practice resulted in a more economical treatment of the materials, than previously attained using prior art apparatus. This results because the reduction in time necessary to treat the materials permits higher production-capacity to capital-expenditure ratio than in known apparatus. The apparatus, according to the instant invention, permits an economical treatment in a continuous flow manner, for the material. This leads to a significant economic improvement over prior art apparatus.

An additional significant contribution to increase the flexibility, lies in the fact that the temperature-time progression during pre-heating in the pre-treatment furnace, is adjustable. The billets or pieces of material can be conveyed step-by-step and each individually pre-treated in stationary condition in the pre-heating furnace, if that it desired. Additionally, the continuous feeding and pre-heating of billets in continuous flow or with intermediate pause is also possible. Finally, a purely continuous flow operation from the pre-heating phase through the final treatment is also possible. As the pre-heating or pre-treatment phase in the pre-treatment furnace is adjustable, it is also possible to pass material continuously through the pre-treatment furnace into the heat treatment furnace using only one transport device.

By the individual treatment of the material, not only is a uniform quality ensured, but also measures against warping or curling of the billets are made possible. For this purpose, it is particularly advantageous if the billets are rotated about their longitudinal axes during the holding, as in principle is known from French Pat. No. 1,150,693. Such a rotation appears to be appropriate to avoid warping or curving, also during the cooling following the heat treatment.

If the material is supplied step-by-step, and is pre-heated in a stationary condition, then in a preferred apparatus according to the invention, it may be placed in the pre-heating furnace in a predeterminable position. In this connection at least one limit switch for the control of the transport device can be arranged in a position in the pre-heating furnace, in which the material is placed in the desired manner. In order to be able to pre-heat different billet lengths without waste of energy, in a further developed embodiment of the instant invention, measuring devices are provided for measurement of the length of the material introduced into the pre-heating furnace, and the heating devices are subdivided into groups, which are controlled by means of the measuring devices as a function of the length of the material.

Accordingly, there is provided an apparatus for heat treatment of a metal piece or metal pieces to be subsequently worked on, such as ingots, billets, rods, tubes, cast strips and cast billets, especially of aluminum or magnesium alloys, wherein the pieces are pre-heated and thereafter held at a predetermined heat treatment temperature for a predetermined time.

A pre-treatment furnace of the apparatus includes a heating device which can be operated to heat the pieces using hot gas impingement. The hot gas is at a temperature essentially higher than the heat treatment temperature, and the heat treatment furnace includes heating devices for providing hot gases and forced circulation of the hot gases. The heating devices include a temperature control device for adjusting and maintaining the temperature of the hot gases.

A transport device includes a pre-treatment transport device and a treatment transport device. The pre-treatment transport device moves the pieces at a pre-treatment speed through the pre-treatment furnace, and the treatment transport device moves the pieces at a treatment speed through the heat treatment furnace. The treatment speed and the pre-treatment speed are independently variable, and include devices for stop-and-go motion, devices for stepwise motion, and devices for continuous motion.

The treatment transport device may be moved in a transport direction and preferably includes stationary beams. Each beam is advantageously formed with saw-tooth-shaped depressions, and each depression has a bottom for receiving the pieces, and is at least partly defined by an oblique surface relatively slightly inclined with respect to the transport direction.

Lifting beams are disposed between respective stationary beams, and may be moved from a rest position below the lifting beams in a lifting direction, and independently also in the transport direction. Each lifting beam has a flat surface and prismatic guards disposed on the surface at respective distances. Each distance exceeds the diameter of each piece, and the pieces may be lifted from the depressions by the lifting beams and lowered in a controlled manner on the oblique surfaces of the succeeding depressions, respectively, as viewed in the transport direction. The pieces may then be freely rolled into the bottom of the depressions, and the lifting beams may be contacted by the pieces upon the pieces being disposed in the depressions, and subsequently moved in a controlled manner in a direction opposite to the lifting direction.

Each piece has preferably a predetermined circumferential dimension, and each oblique surface has a longitudinal dimension differing from the circumferential dimension of each piece.

Each prismatic guard has preferably the form of an angled section; the dimension of the angled section in the transport direction is small with respect to the remainder of the flat surface extending between successive angled sections, so that the pieces may be rolled through a controlled circumferential distance onto the remainder of the flat surface.

It is advantageous if lifting devices are provided for supporting the lifting beams, and are operated simultaneously in the lifting direction, and if a common carriage may be shifted horizontally in the transport direction to support the lifting devices.

It is also advantageous to provide double-acting fluid cylinder devices for selectably moving one of the lifting beams and the carriage in the transport direction, and in a direction opposite to the transport direction. Screw-drive devices are advantageously provided for moving lifting beams in the lifting direction, and in a direction opposite thereof.

Each piece has a longitudinal axis and there is preferably provided a cooling station arranged with means for controlled rotation of each piece about its longitudinal axis. The cooling station is advantageously arranged downstream of the heat treatment furnace. Feeding devices are advantageously provided for feeding the piece to the cooling station.

The devices for controlled rotation of the pieces advantageously include roll pairs; each roll pair has two rolls, which form a prismatic seat for supporting the pieces; at least one roll of each roll pair may be driven.

It is further advantageous to provide a lifting device which may be moved relative to one of the rolls for discharging the pieces; the other roll is preferably mounted on the lifting device.

It is advantageous if a water channel is mounted along the pieces to be treated, the water channel preferably has a lower wall and water discharge openings arranged at the lower wall in a longitudinal direction to the pieces to be worked, and is arranged at the cooling station above the devices for controlled rotation.

Rotating brushes are preferably arranged for cleaning the pieces being provided.

The pre-treatment transport device advantageously includes at least one central switch arranged in the pre-treatment furnace, so that the position of the pieces in the pre-treatment furnace may be controlled by controlling the pre-treatment transport device. The pre-treatment furnace is preferably formed as a chamber furnace with an input and an output at one end and the same side.

The pretreatment furnace may advantageously be heated by circulated hot gas and designed in principally the same manner as the treatment furnace as described in detail in this specification. This leads to an especially simple and cheap construction of the apparatus. In this construction the circulated hot gas used for heating of the metal pieces in the pretreatment furnace should be moved in the direction of movement of the metal pieces. This may be advantageous as well in the treatment furnace.

The transport devices preferably include an intermediate transport device which may be operated for transfering pieces to be treated from a supply device to the pre-treatment furnace, and from the pre-treatment furnace to the treatment furnace. The pre-treatment furnace and the treatment furnace are preferably arranged with their respective transport directions transverse to one another, and the intermediate transport device advantageously operates reversibly.

BRIEF DESCRIPTION OF THE DRAWINGS

For a fuller understanding of the nature and objects of the invention, reference should be had to the following detailed description, taken in connection with the accompanying drawings in which:

FIG. 1 is a schematic view of an apparatus according to the invention with a pre-heating furnace and a successively arranged holding or heat-treatment furnace;

FIG. 3 is a section along the line III—III of FIG. 2;

DESCRIPTION OF THE PREFERRED EMBODIMENT

Figure 2:
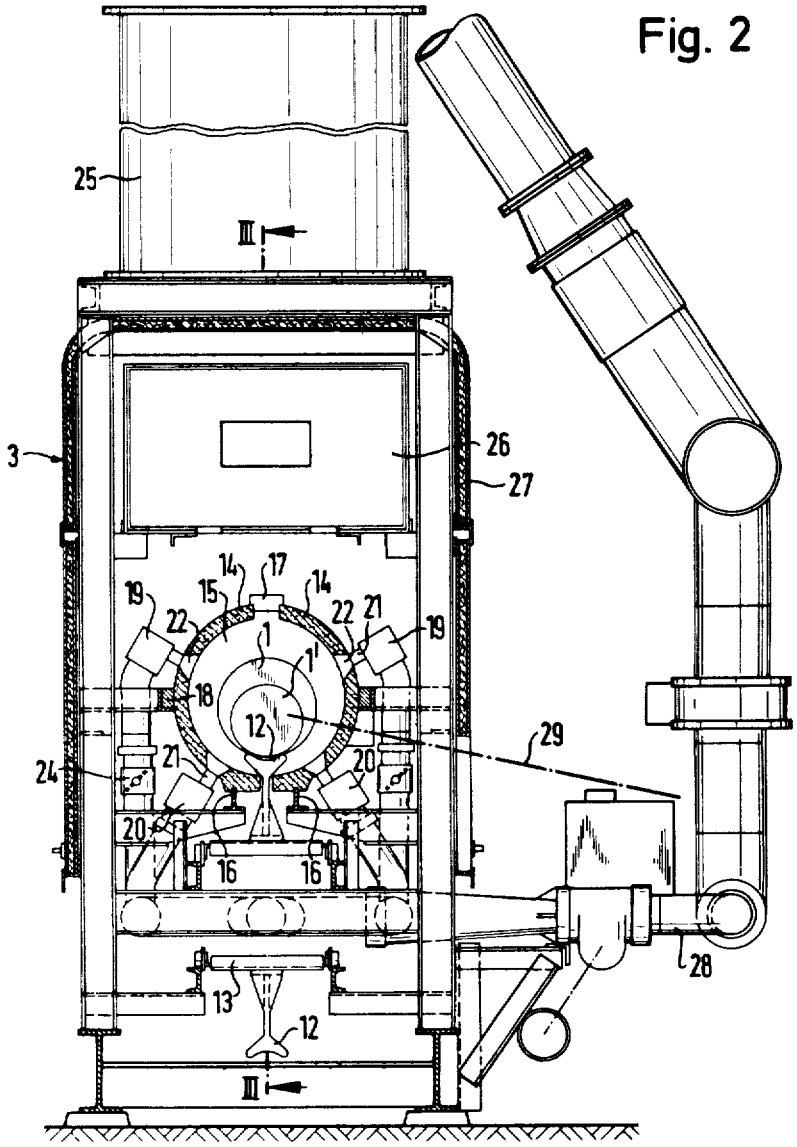
FIG. 2 is a cross-section through a pre-heating furnace which is preferably employed in an apparatus, according to the instant invention.

In the schematic plan view according to FIG. 1, bars or billets are indicated by the reference numeral 1. From a supply device or magazine 2, the billets or bars 1 are automatically transferred individually to a transport device 8, which can supply them step-by-step, in the direction of the horizontal arrows, in to the pre-heating pre-treatment furnaces 3 arranged to the left and right of it, as seen in FIG. 1. The billets or bars 1 are brought rapidly to full annealing temperature individually in the pre-heating pre-treatment furnaces 3, in stationary condition, by hot gas impingement, by means of burners or hot gas nozzles. Thereafter, the individually pre-heated billets are taken out again from the respective pre-treatment furnace 3, and are transferred individually in succession from the transport device 8 into a holding or heat treatment furnace 4. This holding furnace is formed as a continuous flow furnace, and operates with circulated hot gas, for example, hot air. The full annealing temperature is maintained over the length of the holding furnace, or, in the case where the billets at the entry into the holding furnace have not yet entirely attained the full annealing temperature, is reached after a short travel in the holding furnace.

By alteration of the pre-heating time, that is, of the period of time in which the billets 1 are held in the pre-heating furnaces 3, and by control of the burners, the pre-heating temperature can be adjusted finely and over a wide range, which makes it possible that always a uniform pre-heating of the billets is obtained.

The holding time in the holding or treatment furnace 4 can be varied according to the alloy composition of the billets, and the desired structure, by alteration of the speed of through travel. The temperature in the holding furnace 4 can be altered, for example, by control of the temperature of the hot air gas.

In the holding furnace 4, devices are provided for rotation of the billets 1 about their longitudinal axes, so that these are completely uniformly heated and warping or curving cannot occur, or the billets are straightened. The bars, plasticized by annealing, automatically straighten themselves by reason of their own weight.

The billets 1 are transferred from the exit of the heat retaining furnaces 4 either to a processing device 5, or to a cooling station 6, where the billets passing through are cooled individually with water and/or air. At the cooling station 6 there is arranged, as shown in detail in FIGS. 7 and 8, a device for turning the billets during cooling, so that bending or distortion of the billets is prevented due to uniform cooling effect from all sides.

From the cooling station 6, the billets 1 reach a magazine 7, from which they are conveyed to another station for further working.

The separation of pre-heating and heat retaining opens the possibility of individually controlling the temperature and primarily the sequence or transport speed in the pre-heating and heat retaining phase. This leads to a very high flexibility of the whole installation, that means, to an optimal adaptability in each case to the different requirements during operation, such as realization of different peak annealing temperatures, desirable in practice with different alloys, and interrupted operations or operation under part load in adapting to successive devices or to stoppages in the billet supply. By the quick pre-heating with direct flame impingement, the construction of the pre-heating or pre-treatment furnace is smaller than before, so that the space need of the whole installation is reduced. The material flow is greatly improved, and the quantity of the material flow is increased due to the continuous or quasi-continuous performance.

FIGS. 2 and 3 show a preferred pre-heating furnace in detail.

The pre-heating furnace has such a length that a billet of the largest size available in practice (7–8 m) fits into it lengthwise. In the pre-heating furnace 3, there is provided a double strand or strip conveyor chain 13, with carrier devices 12 mounted thereon for the billets 1 to be pre-heated. The carrier devices 12 reach through a longitudinal slot into a cylindrical furnace chamber 15, formed by two furnace shells 14. The furnace shells are each journalled to swing by their lower ends on a carrier rail 16, and are held together above the spacing members 17. Laterally, the furnace shells are supported on the furnace wall by radial supporting bars 18. By removal of the spacing members 17 and slight swinging inwards around the supporting points on the carrier rail 16, the furnace shells 14 can be dismantled without difficulty.

The furnace shells 14 have four radially directed rows of openings 22, into which discharge nozzles 21, of pre-mixed burners 19, 20, are likewise radially directed. The radially directed rows of burners extend over the entire length of the furnace shells 14. In doing so, the lower rows of burners 20 are arranged close to the supporting devices 12, and directed obliquely upwards, while the two upper rows of burners are offset by about 90°, to the corresponding lower rows of burners and directed obliquely downwards. The upper rows of burners 19 can be adjusted by valves 24 with respect to the lower rows of burner 20.

Based on the arrangement of the rows of burners 19, 20, during heating of billets 1 or 1' (of smaller diameter), the surfaces for heat transfer are employed in an optimum manner, so that a circularly symmetrical temperature distribution over the cross-section of the billets is achieved. The burner nozzles 21 are at this time differently adjusted in their output, so that the temperature distribution desired in each case is attained at the end of the pre-heating period, and also the ends of the billets are slightly raised from the carrier devices 12, at the beginning of the pre-heating period, so that no excessive horizontal forces can be exerted on the conveyor chain 13 by the increase in length of the billet produced by heating.

The carrier devices 12 for the billets 1 or 1' have, at the place where they penetrate into the slot formed between the two furnace shells 14, a shaft which is rectangular in cross-section, which fills up the slot except for a safety spacing necessary for thermal expansion.

The flue gases leave the furnace cavity 15 upwards through the slot formed by the furnace shells 14 and the spacer members 17, and are, together with fresh air, sucked away through a suction fan along the exhaust duct 26 into a chimney 25. The outer casing 27 serves in this connection at the same time as an air duct for the fresh air sucked in.

The pipes 28, necessary for the mixing and measuring of the combustion gas, as well as a device 29 for measurement of the temperature of the bars 1 and 1', are arranged at the right hand side of the furnace as seen in FIG. 2.

For pre-heating, the billets are pushed into the furnace from the transport device 8, and are taken over by the carrier devices which are moved by the double-run conveyor chain 13. The drive for the double-run conveyor chain is controlled by a limit switch not shown, which turns off the drive when a billet 1 runs against an abutment 30, at one end of the furnace shells 14.

Measuring devices, not shown, arranged at uniform spacings over the length of the furnace shells 14, measure the length of the billet inserted at each moment. These measuring devices control the burners 19 and 20 in groups, so that at each moment, only a number of burners corresponding to the length of a billet is actuated for pre-heating. The burners are first switched on, when a corresponding billet 1 has reached the position shown in FIG. 3, against the abutment 30.

With shorter billet lengths, it is also possible that the pre-heating furnace 3 is supplied with a plurality of bars.

With the pre-heating furnace shown, a continuous flow operation is also attainable. The billets 1 in this operation are pre-heated in moving condition. The drive is, however, preferably intermittent in this case, so that the necessary matching with the following period of annealing in the holding furnace 4 is achieved.

Figures 4, 5:
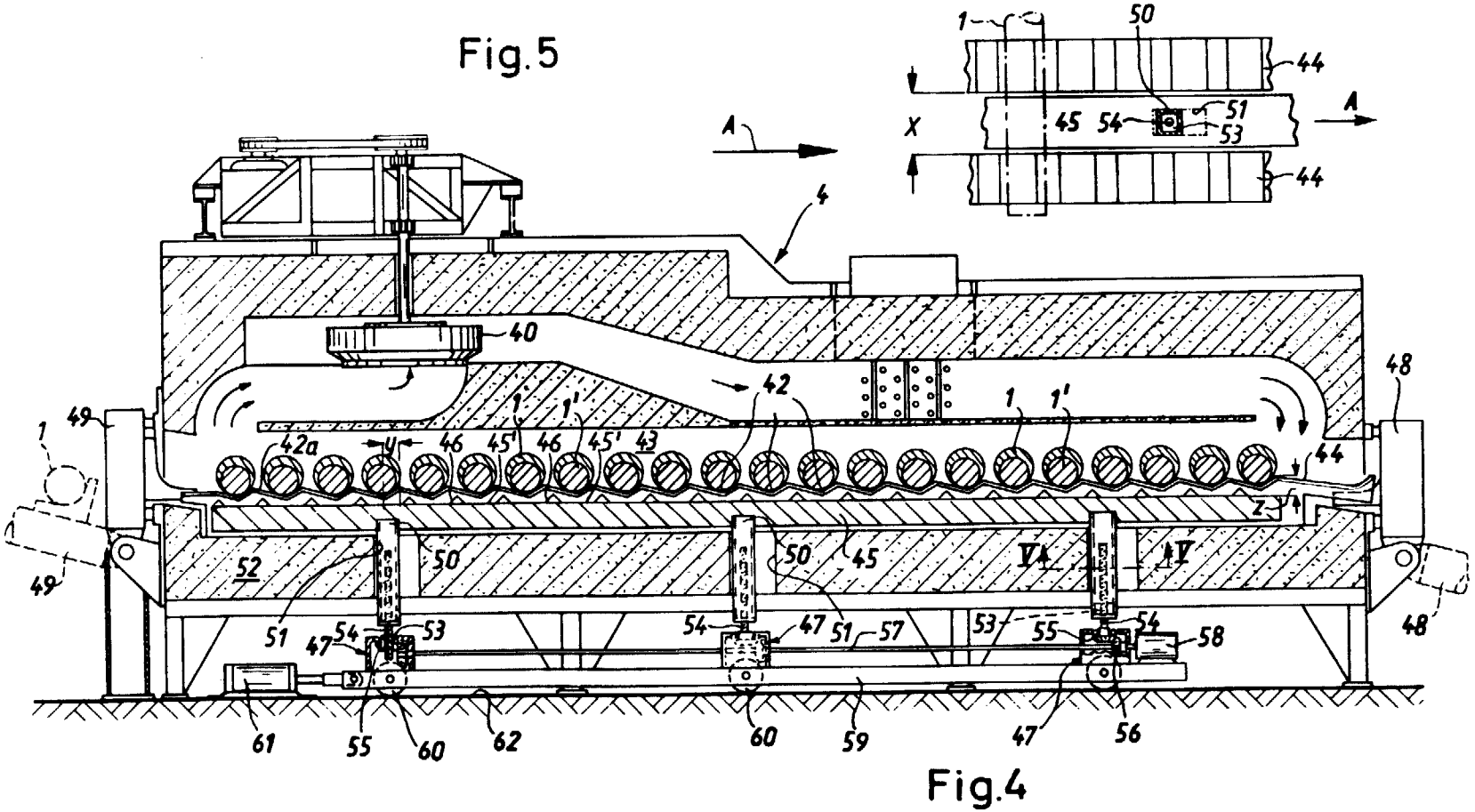
FIG. 4 is a longitudinal section through a holding furnace which can be employed in the apparatus according to the invention, with a transport device constructed in accordance with the invention.
FIG. 5 is a partial section according to line V—V of FIG. 4.

The holding furnace 4, shown in FIG. 4 in longitudinal section, is constructed for continuous flow operation and is heated with hot gas, for instance, hot air, which is blown by a radial-axial blower 40 against the billets 1 or 1', which are to be kept hot, and is circulated in the furnace.

The billets lie in saw-tooth-shaped depressions 42, with oblique surfaces **42*a* of stationary beams 44 extending longitudinally through the furnace space 43. The beams 44 are arranged with spaces in between, at least two of which have a width x (FIG. 5). In the intermediate spaces so defined, there fit lifting beams 45, extending between and parallel to the beams 44. The lifting beams 45 have horizontonal, flat surface portions 45' for receiving the billets 1 or 1', and these surface portions 45' are limited by prismatic abutments, in the form of angle sections 46, welded onto the flat surface of the lifting beam. Adjacent angle sections 46 have a spacing at least approximating to the spacing of adjacent depressions 42**, and, in the transport direction A, have a small longitudinal extent k, (FIG. 6*a*) in comparison with the extent l of the flat surface portions 45', so that round billets 1, 1' of usual diameter, can roll on the flat portions 45'. The angle sections 46 serve simply as safety abutments, not normally used, if the billets 1, 1' for any reason, e.g., in the raised condition, are found to be turned, for example, by reason of a twist received during lifting. Three lifting pipes 50 of square cross-section engage each lifting beam 45 from below; they are vertically movable, but non-rotatably held in rectangular longitudinal slots 51 on the floor 52 of the heat maintaining furnace. One of these longitudinal slots 51 is shown, for better understanding, in dot-and-dash lines in FIG. 5, where the floor is omitted.

One possible construction is shown at the right in FIG. 4. Into the lower end of each lifting pipe 50, there is welded a nut 53, which is passed through by a spindle 54, making screw-threaded engagement therewith.

Each spindle 54 carries at its lower end a bevel pinion 55, which meshes with a bevel pinion shifted by 90°. All bevel pinions 56 are arranged on a joint horizontal shaft 57, which is actuable by a drive motor 58, in order to start moving the lifting pipes 50, and therewith the lifting beams 45.

The shaft is journalled in housing 47, each associated with a corresponding spindle 54, lifting pipe 50, and bevel pinion pair 55, 56. The motor 58 and the housing 47 are mounted on a carriage 59, which operates on rollers 60. This carriage is movable, along the ground or on rails 62, by a double-acting fluid cylinder 61, through a horizontal stroke y, which corresponds approximately to the horizontal component of the length of the oblique surfaces 42*a*. The vertical travel z of the lifting beam 45, which is produceable via the above-described lifting device by the motor 58, is made of such extent that, in lowered condition, the lifting beam 45, with the angle sections 46, can be freely pushed beneath the billets 1, 1', and in the raised condition the billets 1, 1', lying on the lifting beams 45, do not engage on the oblique surfaces 42*a* of the saw-toothed depressions 42 during horizontal transport.

In a preferred second embodiment (illustrated in FIG. 4, at the left hand spindle gear), the nut 53 of each spindle gear is movably held in the housing 47, and tightly connected with the lower end of the lifting pipe 50, and not turnable, but vertically movable in the housing 47, and shiftable in its axial direction. All component parts of the spindle gear are in this case lodged and mounted in the housing 47, and the lifting pipe 50 does no longer contain any movable parts of the drive gear. This is advantageous for mounting and maintenance.

The transport of the billets 1 by means of the transport device shown in FIGS. 4 and 5, will now be described with reference to FIGS. 6*a* to 6*e*.

In the rest position of the lifting beam 45 (FIGS. 4 and 6*a*), and depressions between the angle profiles 46 are slightly shifted ahead of the depressions 42. In principle, the transport device would also function without the angle profiles 46, that means, with lifting beams having a horizontal flat surface.

Figures 6A, 6B, 6C, 6D, 6E:
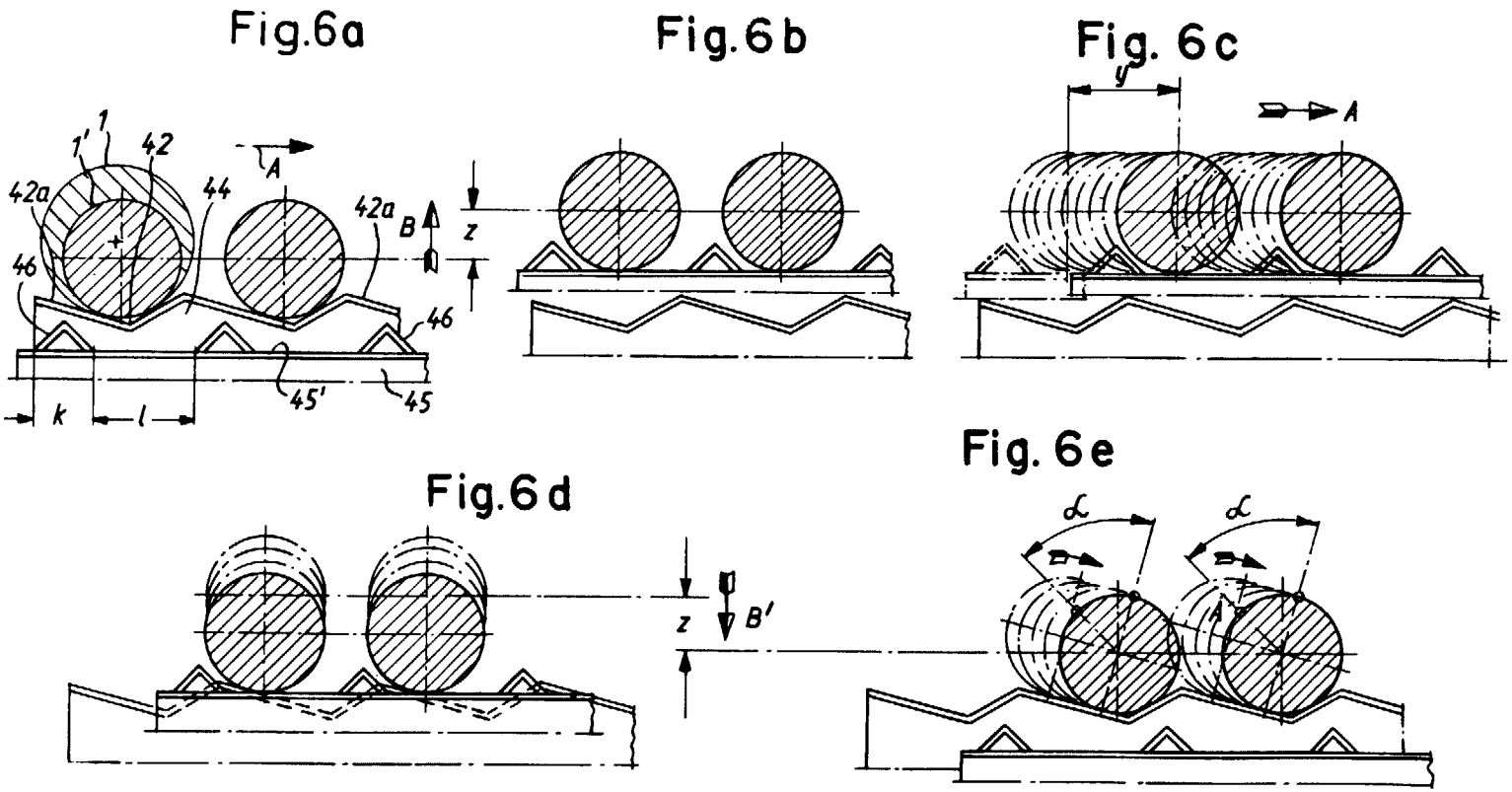
FIGS. 6*a* to 6*e* are transport phases succeeding one another in time, in transporting the material through the heat retaining furnace.

As can be seen from FIG. 6*a*, a billet 1 with larger diameter lies in the depression 42 with its center offset against the transport direction A. This arises from the slight inclination of the inclined surface 42*a* in comparison to the opposite surface (which has no reference numeral).

In the rest position according to FIG. 6*a*, the billets lie in the depressions 42 of the stationary beams 44. The lifting beams 45 lie below the stationary beams. By actuation of the spindle gears, the lifting means are now moved upwards in a lifting direction B, engaging the billets 1 and lifting these upwards from the depressions 42 through the distance z (FIG. 6*b*).

After completion of lifting movement, each lifting beam 45 is moved to the right as shown in FIG. 6*c*, by means of the drive cylinder 61, through the distance y in the transport direction A. During this movement, the billets 1 move to above the oblique surface 42*a* of the next following depressions 42 in the transport direction. In this way one ensures that even bars which are curved before heat treatment can be carried without trouble through the holding surface.

After completed advance of the beam in the transport direction A, the spindle gear is again actuated, but now in a direction B', which is counter to the lifting direction B. The speed of this movement is controlled in such a way that the bars are gently lowered onto the oblique surfaces 42*a* of the stationary beams (FIG. 6*d*). The bars 1 roll now due to their own weight from the oblique surfaces 42*a* into the depressions 42. During this motion, they turn about an angle (FIG. 6*e*). However, this rolling off movement is controlled by the lowering movement of the lifting beam in the direction B', that means, braked to such an extent that no impact blow is created at arrival in the depression 42, that would damage the shape and surface of the bars which are annealed to plasticity.

The length of the oblique surfaces 42*a* is so proportioned that the bars reach the depressions 42 with the circumferential section turned about the angle, that is at each next following depression with another section, so that in each case these other sections come in contact with the circulated hot gas, or the circulated hot air. Hereby the bars in all their areas may be maintained on a very uniform temperature. The rolling off of the bars on the oblique surfaces 42*a* controlled by the downward movement of the lifting beam 45 leads to the automatic straightening of the bars due to their own weight for eliminating curvatures that might have occurred for any reasons.

In the manner described, the bars are transported through the heat treatment furnace avoiding any wedging-in between the lifting beam 45 and the stationary beams 44, so that the risk of damaging the bars is practically eliminated.

Simultaneously with the lifting movement of the lifting beams 45, the furnace doors 48, 49, are opened for admitting or discharging the bars 1 or 1'. The furnace doors 48, 49 are shown in FIG. 4 in broken lines in open position. The loading and emptying of the holding furnace 4 can also take place in the longitudinal direction of the billets 1 by doors provided on one side of the holding furnace, in which case the doors 48, 49 are omitted.

In practice the billets can attain weights of the order of 1 ton. Hence, according to the number of billets received at once in the furnace, between 25 and 40 tons must be lifted, lowered and transported, in a controlled manner. This is not possible with a usual combined drive, such as an eccentric drive, and has been attainable for the first time by the separation of lifting and transporting motions, according to the invention.

Figure 7:
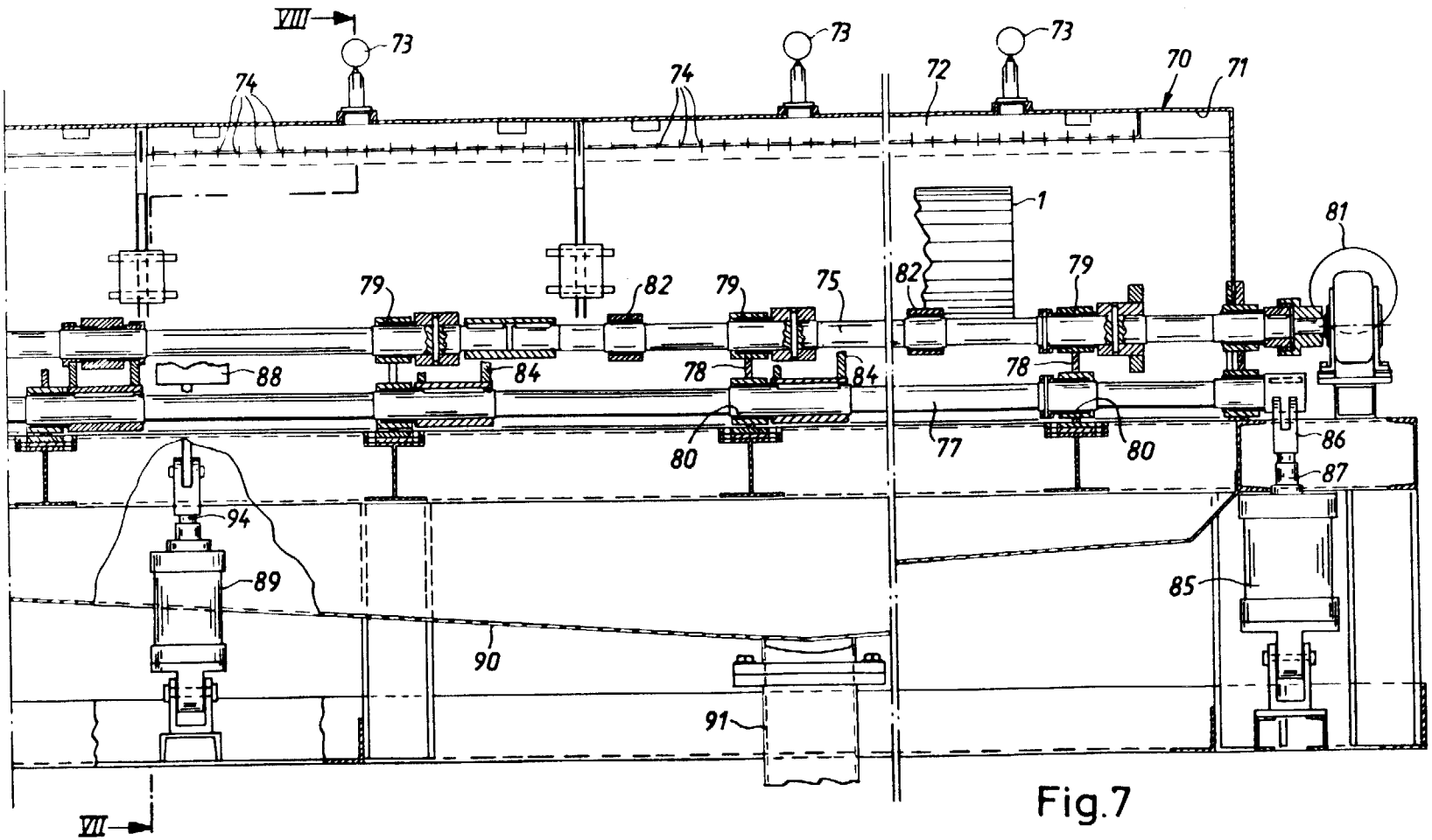
FIGS. 7 and 8 are, respectively, a longitudinal section of a shower device, and a cross section according to line VIII—VIII of FIG. 7.
Figure 8:
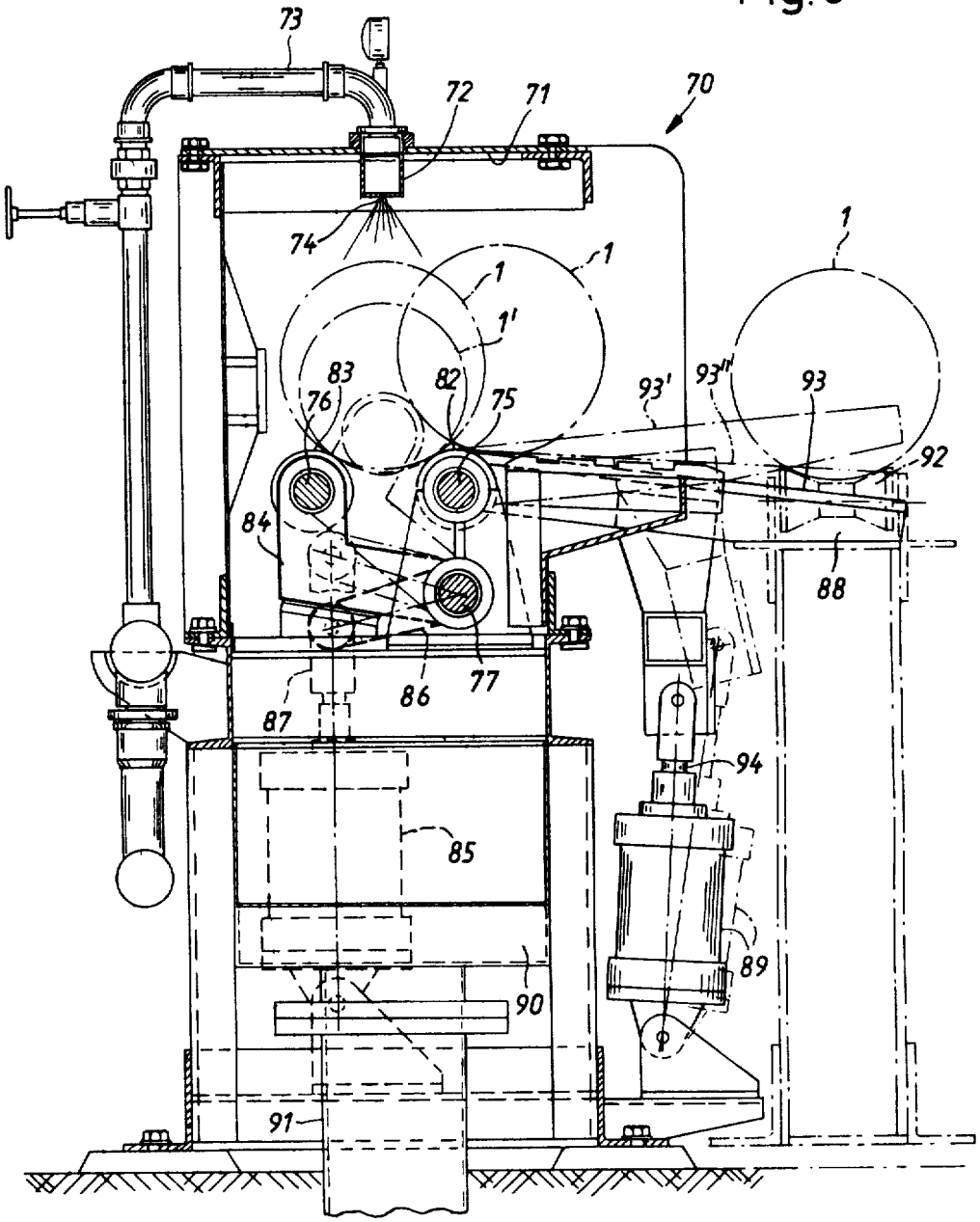

The cooling station shown in FIGS. 7 and 8 has a spray chamber 70, on the upper wall 71 of which there is mounted an internal closed water channel comprising several segments 72 aligned in succession in the longitudinal direction. Each segment 72 of the water channel has a separate water supply pipe 73 and in its lower wall is provided with spray holes 74 which are arranged close to one another in a row in the longitudinal direction of the water channel. Below the water channel a shaft 75, aligned axles 76, and a shaft 77 extend through the spray chamber, parallel to one another. The shafts 75, 77 and the axles 76 are all supported in bearing blocks 78, the shafts 75, 77 and the axles 76 being movable in journals 79, 80.

The shaft 75 is driven by a drive motor 81 arranged outside the shower chamber 70, and carries rolls 82 arranged on it movably at regular distances.

The axles 76 are shiftably mounted to rock about the shaft 77 by means of at least two rockers 84. In the normal position shown in FIG. 7, the axles 76 lie in the same horizontal plane as the shaft 75, and are spaced from it at a distance adjusted to the measurements of the billets 1 and 1' to be worked, which distance is smaller than the bar diameter.

On the axles 76 there are turnably mounted rolls 83 of the same diameter as the rolls 82 of the shaft 75. The rolls 82, 83 are associated in pairs and form a prismatic recess for the billets 1 or 1'. The rockers 84 supporting the axle 76 are rigidly connected to the shaft 77. This shaft 77 is shiftable by one or two pivoted cylinders 85, and a crank arm is fixed to the shaft 77 and pivoted to the fork 86 of the piston rod 87 of the cylinder 85. The rocker 84 is shown in rotated position in dot-and-dash lines.

There is furthermore provided at least one transfer arm 88 to feed the bars 1 into the spray device. This arm 88 is shiftable by a cylinder 89 with a piston rod 94, between the two positions shown in full and in dot-and-dash lines 93' and 93'', respectively, about the axis of the shaft 75.

In the lower portion of the spray chamber 70 there is a collecting tub or reservoir 90 from the deepest location of which there projects a discharge pipe 91 directed vertically downwards.

The spray device described operates as follows:

A hot billet 1 and 1' coming from the heat maintaining furnace is set in motion over a roller conveyor 92 arranged alongside the spray device. The cylinder 89 has been actuated, so that the transfer arm 88 lies below the track of the billet 1. When the conveyor 92 stops, the cylinder 89 is extended, and hence the transfer arm 88 lifted, raising the billet 1 from the position shown in dot-dash lines, so that the billet may roll along the flat surface 93 of the transfer arm 88, which is now slightly sloping towards the rolls 82,83, and thereby may reach the prismatic recess between the rolls 82,83.

In order that the billets 1 do not, during transfer, fall into the prismatic recess between the rolls 82,83, and thus become damaged, the cylinder 85 is actuated with the cylinder 89, or is still in the actuated condition from the previous working cycle, in which the rockers 84 assume the raised position shown in broken lines. In this position the roll 83 engages gently the billet 1 rolling along the transfer arm, without danger of damage to the billet surface. Thereafter the cylinder 85 is actuated further, so that the rocker 84 arrives in a controlled manner in the lowered position shown in full lines, so that the billet is laid gently into the prismatic recess. Thereafter, the driving motor 81 begins to rotate the shaft 75, and thus the rolls 82, clockwise as seen in FIG. 8, so that the billet in the prismatic recess formed by the rolls 82,83 is set into continuous anticlockwise rotation about its longitudinal axis. The rockers 84 with the axle 76 and rolls 83 are supported resiliently in the lower position by the residual column of air still present in the cylinder 85 in the lowered condition, so that any impacts which may arise during the rotation of the billet 1 are yieldingly resisted, and the danger of surface damage or bending of the billet by such impacts is avoided. Now water is sprayed through the spray holes 74 onto the billet 1 or 1'. As the spray holes 74 are arranged over the whole length of the billet, at small distances from one another, a very uniform cooling of the billet is achieved. For discharging the cooled billet, the piston rod 87 of the cylinder 85 is extended, after previous retraction of the cylinder 89, and consequent shifting the transfer arm 88 into the lower position shown in full lines, so that the rockers 84 and the axles 76 move from the full-line position into the dot-dash-line position. This moves the billet out of the prismatic recess between the rolls 82,83 onto the new outwardly sloping surface 93 of the transfer arm, from which it rolls down onto the roller conveyor 92 for further handling, so that the piston rod 94 of the cylinder 89 is totally withdrawn, and the transfer arm 93 is consequently carried into the lowest position shown in solid lines.

In the example shown in FIGS. 2 and 3, the pre-heating furnace employs direct flame impingement for heating. Alternatively the billet in the pre-treatment furnace may be heated by streams of hot gas. As yet another alternative, the pre-treatment furnace may be heated electrically. The treatment furnace 4 shown in FIG. 4 is heated with hot gas. Alternatively it may be heated electrically.

In still another advantageous alternative the preheating in the preheating furnace may advantageously be performed in the same manner as described above in connection with FIG. 4, wherein, however, the heating gas is moved in the neighbourhood of the metal pieces in direction of and parallel to the arrow A in FIG. 4 and not in the opposed direction. The transport device used in the pretreatment furnace may advantageously be constructed identically with the transport device used in the treatment furnace and described in connection with FIG. 4.

We wish it to be understood that we do not desire to be limited to the exact details of construction shown and described, for obvious modifications will occur to a person skilled in the art.

Having thus described the invention, what we claim as new and desire to be secured by Letters Patent, is as follows:

1. In an apparatus for heat treatment of a metal piece or metal pieces to be subsequently worked on, such as ingots, billets, rods, tubes, cast strips and cast billets, especially of aluminum or magnesium alloys, wherein the pieces are preheated, each piece having a predetermined diameter, and thereafter the pieces are held at a predetermined heat treatment temperature for a predetermined time, comprising, in combination:

heating means operable for heating and preheating, respectively, said pieces, a transport device movable in a transport direction, with relation to said heating means, including a plurality of stationary beams, each of the beams being formed with a plurality of sawtooth-shaped depressions, each of the depressions having a bottom for receiving the pieces, and being at least partly defined by an oblique surface relatively slightly inclined with respect to the transport direction; and a plurality of lifting beams disposed between the stationary beams, respectively, movable from a rest position below said lifting beams in a lifting direction, and independently thereof also in the transport direction, each of the lifting beams having a flat surface and a plurality of prismatic guards disposed on said surface at respective distances, each of said distances exceeding the diameter of each of the pieces, said pieces being liftable from said depressions by said lifting beams and lowerable in a controlled manner on the oblique surfaces of the succeeding depressions, respectively, as viewed in the transport direction, said pieces being thereupon freely rollable into the bottom of said depressions, said lifting beams being contactable by said pieces upon the pieces being disposed in said depressions, and subsequently movable in a controlled manner in a direction opposite to the lifting direction.

2. Apparatus according to claim 1, wherein each of the pieces has a predetermined circumferential dimension, and each of said oblique surfaces has a longitudinal dimension differing from the circumferential dimension of each of said pieces.

3. Apparatus according to claim 1, wherein each of said prismatic guards has the form of an angled section, the dimension of said angled section in the transport direction being small with respect to the remainder of said flat surface extending between successive of said angled sections, whereby each of the pieces is rollable through a controlled circumferential distance onto the remainder of said flat surface.

4. Apparatus according to claim 1, further comprising a plurality of lifting means for supporting said lifting beams and operable simultaneously in the lifting direction, and a common carriage shiftable horizontally in the transport direction and supporting said lifting means.

5. In an apparatus for heat treatment of a metal piece or metal pieces to be subsequently worked on, such as ingots, billets, rods, tubes, cast strips and cast billets, especially of aluminum or magnesium alloys, wherein the pieces are preheated for a predetermined time, each piece having a predetermined diameter and a longitudinal axis, comprising in combination:

heating means operable for heating and preheating, respectively, said pieces, a cooling station provided with means for controlled rotation of each of the pieces about its longitudinal axis with relation to said heating means, said controlled rotation means including a plurality of roll pairs, each roll pair having two rolls, the two rolls of each roll pair forming a prismatic seat for supporting the pieces, at least one of the two rolls of each roll pair being drivable, said cooling station being arranged downstream of a heat treatment furnace, feeding means for feeding the pieces to said cooling station, and a lifting device movable relative to one of said rolls for discharging the pieces, the other of said rolls being mounted on said lifting device.

6. Apparatus according to claim 5, further comprising double-acting fluid cylinder means for selectably moving one of said lifting beams and said carriage in the transport direction and in a direction opposite to the transport direction.

7. Apparatus according to claim 5, further comprising screw-drive means for moving said lifting beams in the lifting direction and in a direction opposite thereto.

8. Apparatus according to claim 5, further comprising a water channel mounted along the pieces to be treated, said water channel having a lower wall and a plurality of water discharge openings arranged at said lower wall in a longitudinal direction with respect to the pieces to be worked, and being arranged at said cooling station above the means for controlled rotation.

9. Apparatus according to claim 5, further comprising rotating brushes for cleaning the pieces being provided.

* * * * *